US005522676A

United States Patent [19]

Gryba

[11] Patent Number: 5,522,676

[45] Date of Patent: Jun. 4, 1996

[54] UNDERCUT EXCAVATION METHOD

[75] Inventor: Charles M. Gryba, South Porcupine, Canada

[73] Assignee: 998492 Ontario Inc., Timmins, Canada

[21] Appl. No.: 48,675

[22] Filed: Apr. 19, 1993

[30] Foreign Application Priority Data

Oct. 2, 1992 [CA] Canada ..... 2079694

[51] Int. Cl.[6] ..... F02D 29/055

[52] U.S. Cl. ..... 405/134; 299/111; 405/149

[58] Field of Search ..... 405/132, 134, 405/138, 139, 149; 299/11, 12; 52/169.8, 169.9, 295

[56] References Cited

U.S. PATENT DOCUMENTS

| | | | |
|---|---|---|---|
| 1,876,496 | 9/1932 | Goldsborough | 405/149 |
| 3,184,893 | 5/1965 | Booth | 50/532 |
| 3,371,455 | 3/1968 | Fox | 52/169.9 |
| 3,631,680 | 1/1972 | Croydon | 405/139 |
| 4,147,452 | 4/1979 | Ogasawara et al. | 405/134 |
| 4,459,064 | 7/1984 | Berset | 405/138 |
| 5,137,337 | 8/1992 | Seppanen et al. | 299/11 |

FOREIGN PATENT DOCUMENTS 940500 10/1963 United Kingdom .

OTHER PUBLICATIONS

The Canadian Mining and Metallurgical Bulletin, Jun. 1961, Montreal, pp. 420–424.

Mining Magazine, Nov. 1984, pp. 403–407.

*Primary Examiner*—William P. Neuder

*Attorney, Agent, or Firm*—Jacobson, Price, Holman & Stern

[57] ABSTRACT

An excavation method is provided, which is particularly suitable as an undercut-and-fill mining method, wherein posts are inserted into the ground and are used to support a concrete floor of the upper level which serves as a roof for the lower excavation level. Excavation beneath such roof is thereby safely carried out. Also, for mining operations, the excavation is very efficient since it removes essentially 100% of the ore in a single pass. The posts are preferably made of concrete and are inserted into holes drilled in the ground. For greater safety a double post system can be used, which involves placing a second post beside the first and tying them all together with the concrete used to make the floor/roof at any given level of excavation.

25 Claims, 5 Drawing Sheets

UNDERCUT EXCAVATION METHOD

BACKGROUND OF THE INVENTION

1. Field of the Invention

This invention relates to a method for excavation from the top down, usually known as "undercut". More particularly the invention relates to an undercut excavation method using posts which are adapted to support concrete floors that become a roof for the next lower cut or excavation level.

2. Discussion of the Prior Art

The excavation method of the present invention is particularly well suited to excavation of material having poor structural cohesion, such as overburden tills below proposed highrise buildings or of badly fractured or unstable mine rock. The so called "undercut-and-fill" mining method is especially well adapted for the purposes of the present invention. There are many descriptions of the conventional undercut-and-fill mining method in the mining literature, however, probably one of the best is to be found in the article entitled: "Undercut-and-Fill Mining at the Frood-Stobie Mine of the International Nickel Company of Canada, Limited" by J. A. Pigott and R. J. Hall published in The Canadian Mining and Metallurgical Bulletin for June, 1961, Montreal, pp. 420–424.

It is also already known to mine ore by an undercut-and-fill method while providing concrete floors that serve as a roof for the subsequent cut on a lower level. For example, in an article entitled "Kosaka Mine and Smelter" published in the Mining Magazine—November 1984, page 404, a method called underhand cut and fill using an "artificial roof" is disclosed. According to this method, the cross-cuts are back-filled by first installing a layer of reinforcing steel mesh near the floor, followed by pumping in a 500–600 mm thickness of a comparatively weak concrete mix and, when it is dry, backfilling with a mixture of sand, volcano ash and 3.5% cement. When alternate cross-cuts have been completed across the length of the mining block, the intermediate 4 meter wide ribs of ore are also extracted, so that the entire slice of ore is replaced by a continuous layer of reinforced concrete topped by loosely cemented fill. Then, when mining of the next lower cut is undertaken, the concrete which has been placed on the floor of the level above, now forms an artificial roof. However, because of such ground conditions, timber sets are installed at 1 meter intervals under such artificial roof to support the same when excavating the lower cut.

The main problem with the above method is that when mining is carried out under the artificial concrete roof, initially there is no support provided for this roof, and until such support is provided by means of timber sets that are needed at intervals as close as 1 meter apart, workers are exposed to safety hazards from potential fall of the roof and of materials above such roof during the temporary periods of unsupport. Another problem is the requirement of providing supporting timber sets at 1 meter intervals. Due to this, the excavated work area becomes congested with supports, thus restricting the excavation rate to small equipment with limited movement, at high unit cost. Also, short ramps (two meters or less) are required to prevent damage to posts and to limit the unsupported spans.

The cost component is an important consideration in mining operations and can dictate the economic viability of several known ore bodies which are presently considered for mining by the undercut-and-fill method. The novel method of the present invention, which lends itself to an efficient, high productivity mechanized excavation will be particularly suitable for such ore bodies.

In the area of civil engineering, the excavation from the top down is presently carried out with the use of sheet piles at great cost. The method of the present invention will again provide a relatively inexpensive and entirely viable replacement for such known practice.

SUMMARY OF THE INVENTION

It is, therefore, an object of the present invention to provide an improved excavating method which is safer, more productive and readily adaptable to mechanization. Another object of the invention is an undercut or undercut-and-fill mining method which is particularly suitable for fractured or unstable rock or for recovering crown or sill pillars and pillars left between cut-and-fill stopes, and entire higher grade ore bodies. Another object is to provide a mining method which gives essentially 100% ore recovery in one pass and allows mining in any desired direction on each lift. Further objects and advantages of the invention will become evident to those skilled in the art from the following description of the invention.

The excavation method of the present invention essentially comprises inserting posts into the ground, pouring a concrete floor on said ground to be supported by said posts, and excavating beneath said concrete floor which now serves as a roof. The posts can be inserted into the ground by any desired means. For example, holes of predetermined size and length can be drilled in the ground and then posts which, for example, can be made of concrete, may be inserted into the holes and positioned therein so as to support the concrete floor that will be poured onto the ground. Alternatively, steel posts could be driven into the ground to a predetermined depth and positioned in a predetermined pattern to provide a support for a concrete floor of a size and shape required for the excavation thereunder.

Then, once the excavation on one elevation level is completed, new posts are inserted into the ground of said first excavation and a concrete floor is poured on said ground to be supported by said new posts and then excavation is continued on a new lower level under said concrete floor which now serves as a roof for the new lower excavation level. In a preferred embodiment, the new posts that are inserted into the ground on the first excavation level are positioned in plan beside the posts that were previously inserted into the ground at the higher level and additional posts are installed on top of the new posts, extending up to and engaging the concrete roof over the first excavation to provide further support for the said roof. Then, when the new concrete floor is poured after installing the new posts, the concrete ties the ends of all these posts when it solidifies and provides a system of double-post support for the concrete roof.

Thus, in a preferred embodiment of the invention there is provided an efficient method of multilevel undercut excavation which comprises:

(a) drilling holes of a predetermined size and length into the ground under which excavation is to take place;

(b) inserting posts in said holes;

(c) pouring a concrete floor onto said ground to be supported by said posts and allowing the concrete to solidify;

(d) excavating beneath the concrete floor which now serves as a roof for the excavation at the lower level;

(e) drilling holes again into the ground at the lower level so excavated and inserting posts in said holes;

(f) installing additional posts on top of the posts inserted at the lower level, extending up to and engaging the concrete roof to provide further support for said roof;

(g) pouring a concrete floor onto the ground of said lower level and allowing the concrete to solidify, thereby tying the ends of the posts; and (h) continuing downward excavation in this manner from level to level until the desired number of levels has been excavated.

Again, in the preferred embodiment of the invention the additional posts inserted in the holes on each lower level, are installed beside the posts already supporting the concrete roof at that level, so as to facilitate tying the ends of all these posts together with concrete when it is poured to form the new floor. Preferably all the posts are made of reinforced concrete, however, one could use a variety of posts, for example, the posts which are inserted into the holes could be made of concrete whereas additional supporting posts could be made of timber or steel. Preferably reinforced concrete is also used for the floors/roofs formed during the excavation, which allows positioning the posts at greater grid spaced distances and provides greater space for excavation beneath such floors.

The above described excavation method can be advantageously used for civil engineering excavations or for undercut mining. In the latter case it is also desirable to drill small (e.g. 5 cm) "helper" holes around the posts and blast the same to pre-break ore around the posts. This also de-stresses the area and facilitates further undercut excavation. Also concrete reinforcing means are preferably provided. For example, rebar and screen are laid on top of a layer (e.g. 200–300 mm) of broken ore before pouring the concrete. Rebar and screen are also extended vertically between and around the posts so that the inserted post cannot punch the concrete floor or alternatively the concrete floor cannot slide down the post without shearing off the rebar, screen and concrete.

Also, in mining operations, the present invention provides a particularly advantageous undercut-and-fill method, which comprises:

(a) cutting initial drifts in an underground mine to form rooms in a conventional manner and recovering the mined material from said rooms;

(b) drilling holes of a predetermined size and length in the sill of each room and inserting posts in said holes;

(c) pouring a concrete floor in said rooms to be supported by said posts;

(d) back-filling the rooms with a suitable fill;

(e) once a complete lift is so mined, repeating this mining procedure on a lower level where the concrete floor now serves as a roof supported by the said posts; and (f) continuing mining in this manner from level to level in the downward direction until the ore body is mined.

Again in a preferred embodiment, additional posts are installed at each level under the first level, between the concrete floor of said level and the concrete roof of the preceding level, to provide further support for said roof. These additional posts are preferably installed in plumb on top of the posts inserted into holes drilled into the sill of each mine level under the concrete roof formed above, so that when the new concrete floor is poured, it ties the ends of all these posts. Also, preferably, the additional posts are positioned adjacent to the original posts supported by the concrete roof so as to facilitate tying them all together and provide a double-post system for supporting the concrete roof at each level.

The holes are drilled in the sill at predetermined grid spaced intervals and the post grid spacing as well as floor post concrete tie-in is so engineered as to provide a safe and economical mining operation. Also, the floor is suitably designed with rebars and screen within the concrete, so that the additional post which engages the roof cannot puncture the same. Again, at least some of the posts and even all the posts could be made of reinforced concrete although some could be made of steel or timber or similar materials.

The actual undercutting is usually done by the drill and blast method, although, again, other excavation methods could be used depending on the ore being mined. If mining is done in a soft ore, such as coal or potash or the like, where mechanized excavation systems are currently used, the method of this invention can readily be adapted to such mechanized methods. In harder rock, normally drill and blast techniques are employed and again the present method is suitable to be used therewith. As previously described with reference to the undercut mining, small blast holes can be drilled around the previously inserted concrete posts in such a way that the blast would break the ore around the posts prior to pouring the concrete floors and also de-stress the ground below, but without producing substantial damage to the posts. Such de-stressing removes the danger of rock burst which often occurs in highly stressed rock formations. Additional de-stress holes may be drilled in the walks or even further below the rooms being excavated, if required.

The method in accordance with the present invention produces in a single pass essentially 100% extraction of the ore from the mined areas where only the posts are left as pillars before the empty rooms are back-filled with a suitable filling material. The second post, as already mentioned, is preferably positioned adjacent to the first post in plumb on top of the post on the level below and tightly fitted under the post on the level above. In this manner, this second post which is never subjected to blasting damage, provides a solid support for the concrete roof above and the back-filled room over said roof. It reinforces the entire system and allows a safe and stable mining operation. However, if required due to some specific ground conditions, additional posts could be placed within the system at different levels to provide even greater support for the roof. For additional safety, the concrete posts can be provided with stress monitoring devices, so that loading on these posts can be monitored by mining crews and unexpected loads can be identified and supported by additional posts, if required.

For a typical mining environment, one can design a 0.2–0.3 m concrete floor suitably reinforced with rebar and mesh, being supported by 0.5 m diameter reinforced concrete posts on an 8 m by 8 m grid pattern for a 5 m cut. However, this typical design is by no means limitative and other suitable designs can be provided. In this regard, the novel method is very flexible and adaptable to any given mining environment and rock formation.

It should be noted that the initial posts are capable of supporting the roof on their own, allowing a number of rooms to be excavated simultaneously. As excavation continues, at each succeeding cut one will install the posts in holes bored in plumb aside the posts from the preceding lift. Additional posts will then be raised above these posts up to the roof. Each additional precast post so raised, in effect, more than doubles the factor of safety since it will never be subjected to blasting or other excavation abuse. Pouring of successive reinforced concrete floors will tie all these posts together and improve the overall strength. A suitable layer of broken ore can be left on the sill prior to pouring the concrete floor; this helps prevent blast damage to the concrete floor when mining proceeds under the floor which has become a roof. Also individual concrete pours are normally tied together with rebars and screens to form a continuous concrete floor slab tying together the various posts.

Advancing down vertically from cut to cut may be accomplished by progressively increasing the height of an access cut corridor and providing a ramp to the lower cut elevation. Ultimate design and spacing of the double post grid will depend on horizontal and vertical pressures exerted by the materials being excavated as well as the weight of the several floors formed on the upper excavated levels, including the backfilled material supported thereby. Also, the concrete floors must be designed to transmit these pressures to the posts taking into account the friction and shear effects of the fill and the concrete floors.

The excavation rate of the undercut-and-fill method of the present invention is very high. Volumes as large as 320 cubic meters per shift can be excavated in any one direction beneath the concrete floor. The method is also very flexible in allowing excavation or filling at several working places at once. Each trend can open up three rooms for excavation, left, right, and straight ahead, allowing for greater flexibility than traditional methods which can proceed only in a straight line. Such spacious design, allows for excavation to be mechanized using loaders, scooptrams and drill jumbos for quick and efficient operation. Mining functions, such as drilling, loading of blast holes, mucking of broken material, drilling post holes, pouring concrete floors, etc. can all be spaced out to optimize the excavation cycles.

Such a method is dramatically more economic than conventional undercut-and-fill mining method mainly because of its continuous work cycle. There are minimum work interruptions because numerous rooms can be opened up as the concrete posts are designed to support a large open area. There is also no need for the usual roof support means such as screens, rock bolts and the like.

Safety is also enhanced as personnel are never exposed to falls of material.

The method is also very cost effective for civil engineering excavation purposes. Supports during excavation become temporary or permanent floors and pillars depending on the design requirements. The method is particularly suitable for excavating underground parkades for multi story basement highrises where other techniques are not very suitable.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
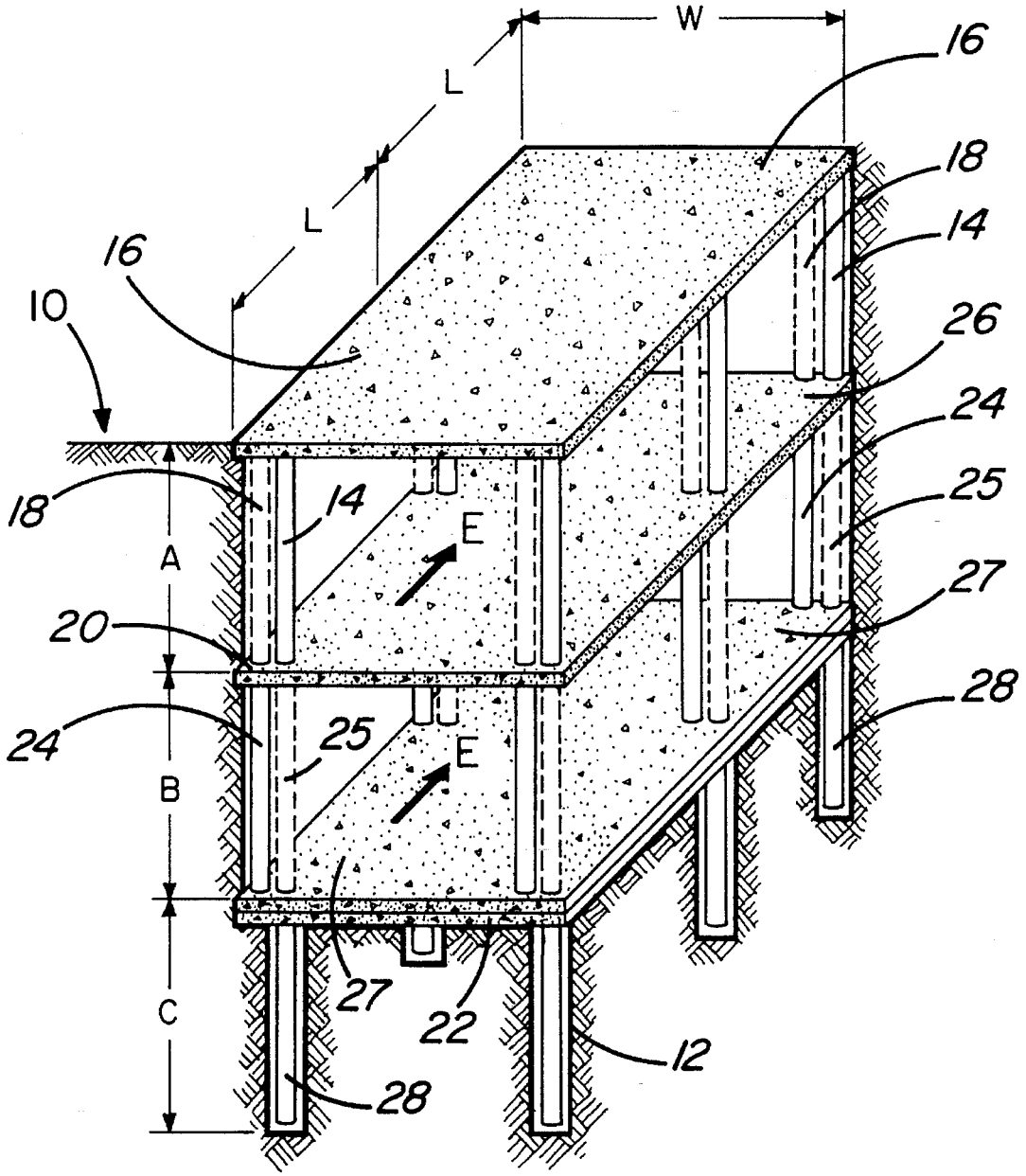
FIG. 1 is a perspective view of an excavation according to the method of the present invention.

Referring to the drawings, in FIG. 1 ground 10 represents any surface from which the excavation according to the present invention proceeds in the downward direction. In this ground 10, which can be on the surface of the earth or in an underground mine, holes such as hole 12 are drilled using, for example, Ingersol Rand's DTH drills, cluster drills or rotary drills. For example, 0.5 m diameter and 5 m deep holes would be drilled at a distance of 8 meters from one another in the longitudinal direction L and in width W and concrete posts 14 of about 0.45 m diameter and approximately 5 m in length would be inserted into said holes. These concrete posts are preferably made of reinforced concrete using rebars or the like as reinforcing elements. Once this is accomplished, a concrete floor 16, having a thickness 0.2–0.3 m, is poured on the ground which is preferably provided with a layer of broken rock or ore. The concrete is also preferably reinforced with screens and rebars as is known in the art to give it greater strength.

Once the concrete floor has solidified, excavation proceeds thereunder, for example, in the direction of arrow E. This excavation can be done by any suitable means and it will be obvious that during such excavation the floor 16 will serve as a solid roof for the excavated space thereunder. In such manner, excavation at level A can proceed safely and efficiently. Also the 8 m×8 m spacings allow for heavy excavation machinery to be used such as LHDs for mucking, 15 ton trucks to truck ore or dump fill, a single or double boom hydraulic jumbo for drilling, a boom truck for mechanized post handling and so on.

As the excavation at level A proceeds, further holes are drilled of the same size and height as holes 12. In plan these holes are drilled off-plumb and immediately adjacent to the existing concrete posts 14. Then concrete posts 24 are inserted into said holes. Again these posts 24 are identical to posts 14, previously inserted into the ground at level A. On top of posts 24, additional posts 18, shown in broken lines, are stood-up and blocked between the ground 20 of level A and the floor/roof 16. These filler posts 18 are similar to posts 14 and 24 but slightly shorter in length so that they can tightly fit between the top of post 24 and the floor/roof 16 and provide extra support for the floor/roof 16. Once all these posts 14, 18 and 24 are properly positioned and secured, concrete floor 26 is poured to tie-in the posts at the bottom 20, thus solidifying the entire structure. Rebar and screen is preferably installed between the various posts to provide further reinforcement when the concrete is poured.

Once level A is thus excavated or mined, it may be back-filled with appropriate filling material. For example a 5% cement-rock fill could be used. Since according to the present invention several rooms can be opened at a time, the pouring of concrete floors, drilling of holes, placing of posts and back-filling of rooms will not slow down the drill-blast-muck-fill cycles of the mining operation. Slinger trucks may be used for tight back-filling with cemented rock fill, but paste fill or cemented sand could also be employed for back-filling.

In mining, when drill-and-blast is used for the excavation, for example, at level A, then original posts 14 could be slightly damaged, although they will always be solid enough to support floor/roof 16 at least initially. Then, when posts 18 are placed, they are never subjected to the blasting operation and are always undamaged and provide solid support for the floor/roof 16.

The same procedure is then repeated at level B where, as the excavation proceeds, holes 12 are drilled in plumb below posts 14 and posts 28 are inserted therein. Then posts 25, shown in broken lines, are stood at level B on top of posts 28 and secured between said posts 28 and the roof 26 providing additional support for said roof 26. These posts 25 are again undamaged by any excavating operation and will, therefore, provide safe support for the floor above even when it is back-filled. Again once posts 24, 25 and 28 are properly positioned and secured, concrete floor 27 is poured to tie their ends with concrete and solidify the entire structure. The same procedure may then be repeated for level C and any additional levels in the downward direction. As mentioned previously, a layer 22 of broken rock or ore is preferably provided prior to pouring the concrete floor 27.

Figure 2:
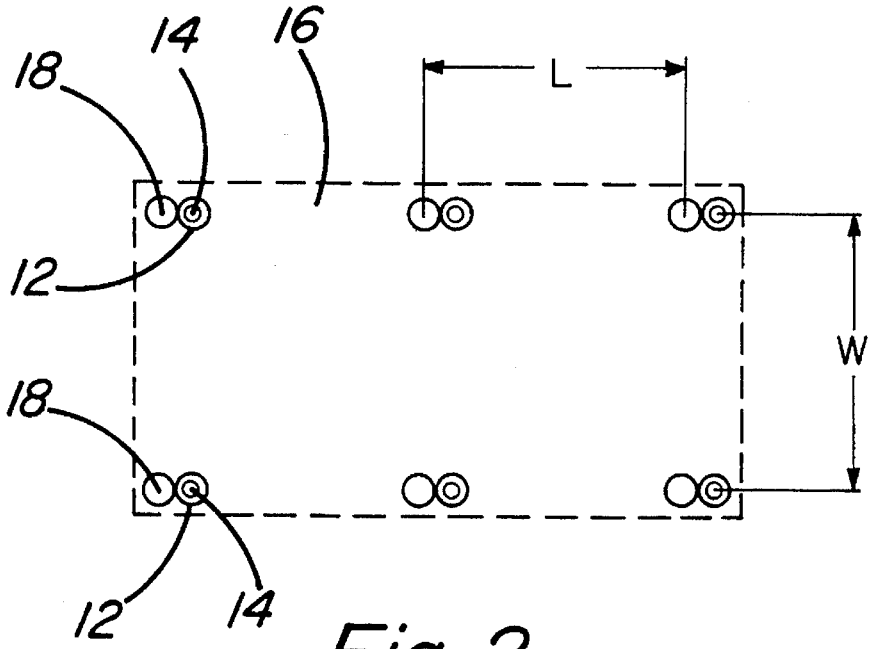
FIG. 2 is a plan view of the same excavation showing the positioning of the posts.

FIG. 2 illustrates, in plan view, the positioning of the double posts in accordance with the preferred embodiment of the present invention at every excavated level. Post 14 is installed into the drilled post hole 12 and post 18 is raised beside post 14 for additional support. Concrete roof/floor 16 is shown in broken lines. Distance L normally corresponds to distance W and, in this preferred embodiment, it is 8 meters. However, post sizes and spacings will be selected to conform with existing rock mechanics and mining practices.

Figure 3:
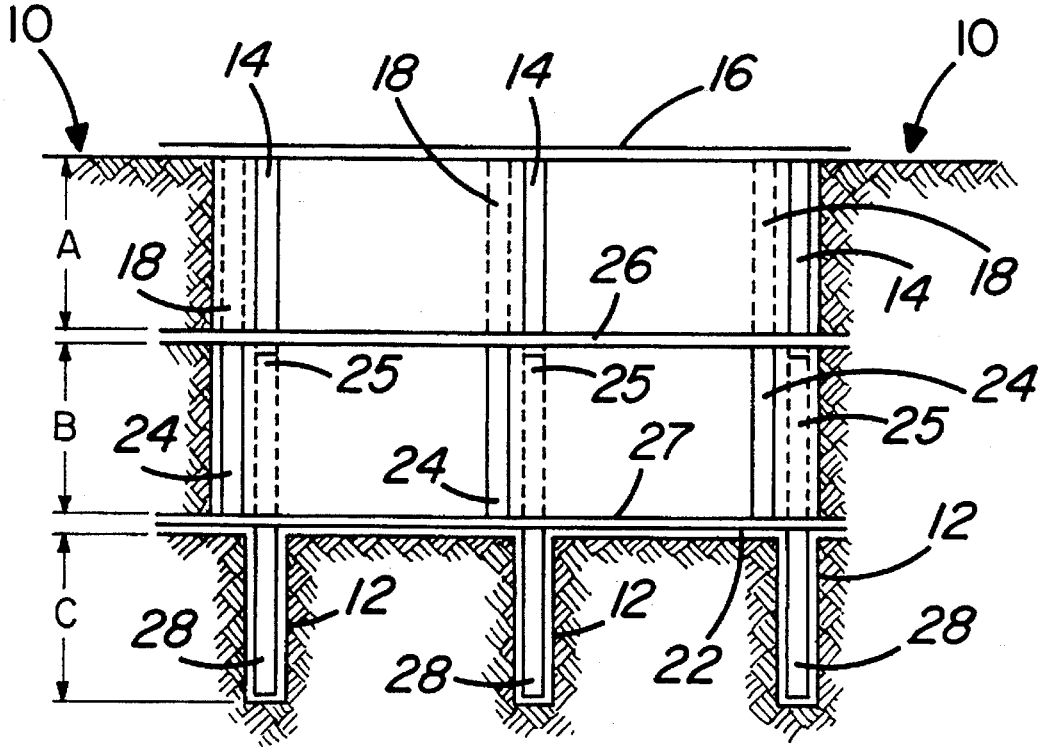
FIG. 3 is a section view of such excavation.

In FIG. 3, the section view of the same arrangement is illustrated. Each level A, B, C is 5 meters high, corresponding to the length of posts 14, 24 and 28. Additional posts 18 and 25 which are stood-up beside posts 14 and 24 are again shown in broken lines. All numerals in this FIG. 3 refer to the same items as in FIG. 1.

Figure 4:
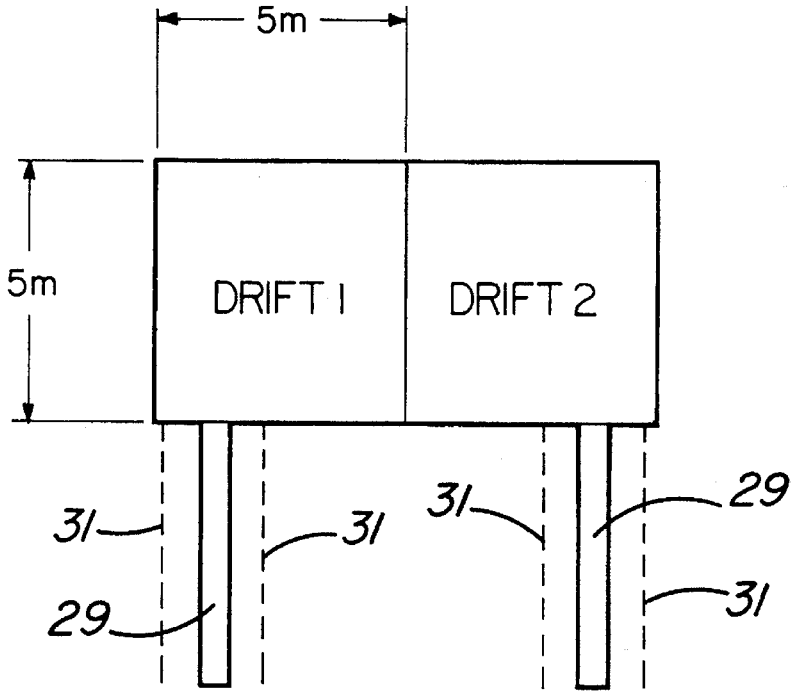
FIG. 4 is a side view of a two-drift mining section showing the positioning of the post holes and of the "helper" or blast holes.

FIG. 4 illustrates a two 5 m×5 m drifts in a mine where the usual 0.5 m diameter by 5 m deep holes 29 are drilled under each drift. Then several (6 or 8) 5 cm helper holes 31 are drilled around holes 29 approximately to the same depth as holes 29.

Figure 5:
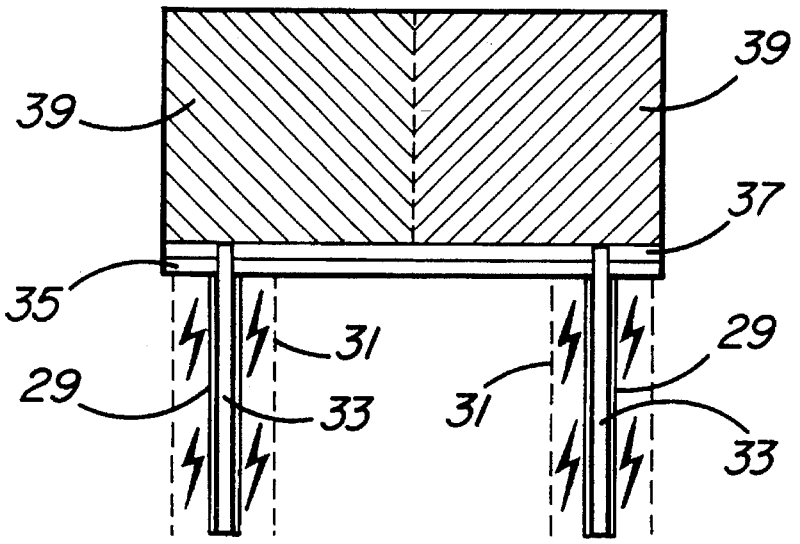
FIG. 5 is a side section view of the same arrangement showing the blasting around the posts and the two-drift sections filled.

FIG. 5 shows the following procedures, namely posts 33 are inserted into holes 29 and holes 31 are blasted to break the area around the posts 33 in the ground below Drift 1 and Drift 2, without damaging said posts 33. The primary purpose for so breaking the ground around posts 33 is to avoid excessive blast vibration transmitted through unbroken rock to the post from subsequent drill and blast mining, which may cause blast damage to the post. Moreover, the subsequent mining blast holes can then be drilled further away from the posts, thus preventing blasting damage when ore is mined around the posts.

Also, there is provided a layer 35 of broken ore on the ground prior to pouring the concrete floor 37 thereon. Rebars and screens may be used to reinforce the concrete. Then, Drift 1 and Drift 2 may be sequentially filled with a suitable filler material 39, such as a 5% cement-rock fill.

Figure 6:
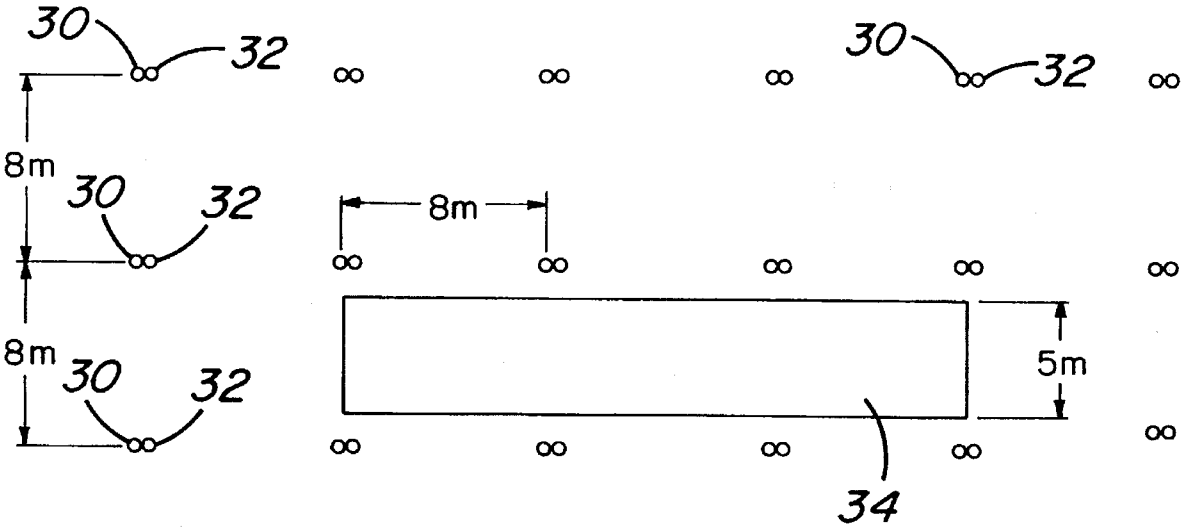
FIG. 6 is a plan view of a grid of post undercut mining level with a ramp from one level to the other.
Figure 7:
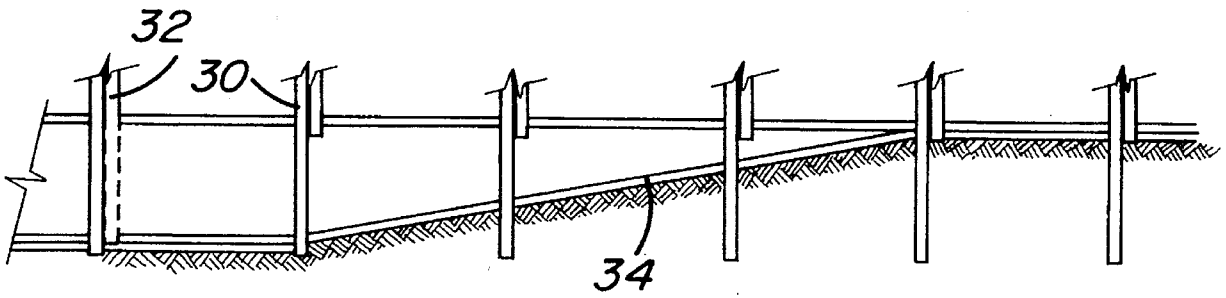
FIG. 7 is a section view of the same grid.

FIG. 6 illustrates, in plan view, a grid of post undercut mining level in accordance with a preferred embodiment of the present invention. Posts 30, 32 are respectively posts installed into a drilled hole and posts raised at their side for additional roof support. These posts can be at any mining level and according to this embodiment are installed 8 m apart. A 5 m wide ramp 34 is provided to give access from one level to the next lower level. As shown in FIG. 7, this ramp 34 is also provided with a concrete floor, for example 0.3 m thick. Such ramps can be permanent or temporary depending on the mining sequence.

Figure 8:
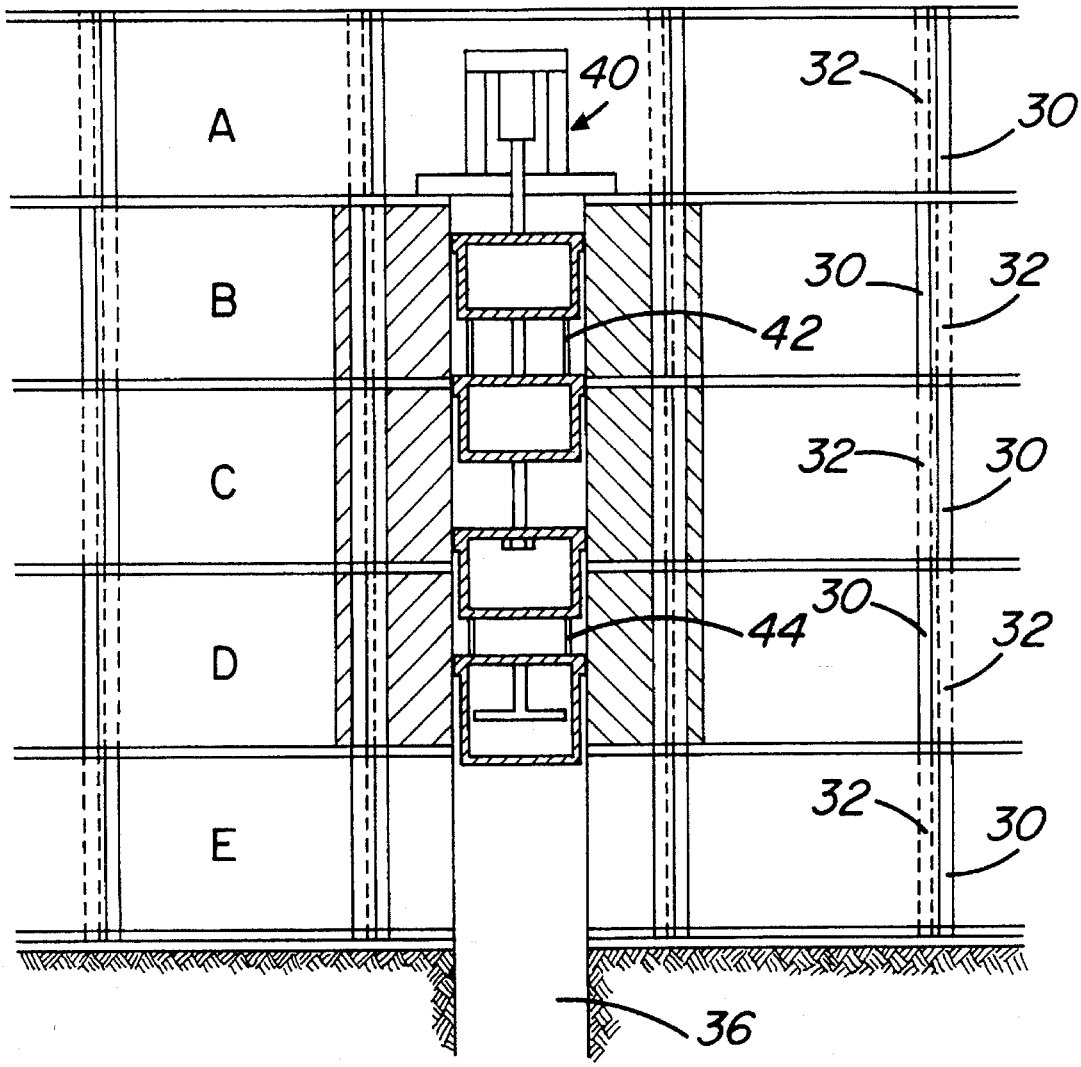
FIG. 8 is a section view of undercut post mining section with a raise bore for supplying various equipment.

In FIG. 8, there is shown a multilevel mining arrangement having a raise bore hole 36. In this embodiment a steel lined 4 m diameter raise bore hole is provided through which various mining equipment is supplied. The raise bore machine 40 is used to lower cages 42, 44 with service vehicles, drill jumbos and the like.

Again in this embodiment the double-post system of the present invention, with posts 30, 32 supporting concrete roofs of levels A, B, C, D and E would be very suitable. As the upper levels A, B, C, D are mined, they are then back-filled as in the conventional undercut-and-fill mining method. According to this embodiment, each level is 5 m high which essentially corresponds to the length of the inserted posts 30. Posts 32, shown in broken lines, are the additional roof supporting posts which are stood-up beside inserted posts 30.

The key to the undercut post excavation method of the present invention are the posts used to support continuous concrete roofs. These posts must be designed to provide adequate compressive strength to support the concrete roof. When concrete posts are used, in accordance with the preferred embodiment of the present invention, they are normally manufactured on surface and then lowered to the mine as required. For 0.45 m diameter posts, reinforced concrete is used, in the form of 7 cm×7 cm mesh on outside and a suitable number of vertical rebars on the inside. The load capacity of such posts is about 500 tons per post or when 2 posts at each location are used, 1000 tons per location which is entirely sufficient to support an 8 m×8 m×0.3 m concrete roof plus the back-fill over said roof. The posting or inserting of such posts into pre-drilled holes is a relatively quick and mechanized operation. A Hiab boom mounted on a mobile truck can be used to insert three or more posts per hour.

It should be pointed out that only a preferred embodiment of the invention has been illustrated and discussed above by way of example and it should be understood that the invention can be adapted to many various conditions and practised in many different ways without departing from the spirit thereof and the scope of the following claims.

What is claimed is:

1. A method of excavation which comprises:

(a) inserting posts into the ground, said posts having top ends which are capable of supporting a concrete roof and said posts being inserted into the ground so that said top ends are essentially flush with the ground;

(b) pouring a concrete floor on said ground and on the top ends of said posts; and (c) excavating beneath said concrete floor which now serves as the concrete roof for the excavation.

2. Method as claimed in claim 1, in which holes of predetermined size and length are drilled in the ground and the posts are inserted into said holes.

3. Method as claimed in claim 1, in which said posts are inserted in a predetermined pattern to provide a floor of a size and shape required for the excavation thereunder.

4. Method as claimed in claim 1, in which small blast holes are drilled around the holes with inserted posts and are blasted to break the ground around said posts without damaging the posts.

5. Method as claimed in claim 1, in which once the excavation on one level is completed, new posts are inserted into the ground of said first excavation and a concrete floor is poured on said ground to be supported by said new posts and then excavation is pursued on a new lower level under said concrete floor which now serves as a roof for the new lower excavation level.

6. Method as claimed in claim 5, in which the new posts that are inserted into the ground of the first excavation are positioned beside the posts that were previously inserted into the ground at the higher level.

7. Method as claimed in claim 6, in which additional posts are installed on top of the new posts, extending up to and engaging the concrete roof over the first excavation to provide further support for said roof.

8. Method as claimed in claim 7, in which the new concrete floor is poured after installing the new posts so as to tie the ends of all these posts when the concrete solidifies.

9. A method of multilevel undercut excavation which comprises:

(a) drilling holes of a predetermined size and length into the ground under which excavation is to take place;

(b) inserting posts in said holes;

(c) pouring a concrete floor onto said ground on top of said posts and allowing the concrete to solidify;

(d) excavating beneath the concrete floor supported by said posts, said concrete floor now serving as a roof for the excavation at a lower level;

(e) drilling holes again into the ground of the lower level so excavated and inserting posts in said holes;

(f) installing additional posts in plumb on top of the posts inserted at the lower level, extending up to and engaging the concrete roof to provide further support for said roof;

(g) pouring a concrete floor onto the ground of said lower level and allowing the concrete to solidify, thereby tying the ends of the posts; and (h) continuing excavation in this manner from level to level until the desired number of levels has been excavated.

10. Method as claimed in claim 9, in which the additional posts installed in plumb on top of the posts previously inserted into the holes on each lower level, are installed beside the posts already supporting the concrete roof so as to facilitate tying the ends of all these posts together with concrete.

11. Method as claimed in claim 9, in which all the posts are made of reinforced concrete.

12. Method as claimed in claim 11, in which small blast holes are drilled around the holes with inserted concrete posts and are blasted to break the ground around said posts without damaging the posts, prior to pouring the concrete floor.

13. Method as claimed in claim 9, in which the posts that are inserted into the holes are made of reinforced concrete, whereas additional supporting posts are made of timber or steel.

14. Method as claimed in claim 9, in which reinforced concrete is used for the floors/roofs formed during the excavation.

15. An undercut-and-fill mining method, which comprises:

(a) cutting initial drifts in an underground mine to form rooms in a conventional manner and recovering the mined material from said rooms;

(b) drilling holes of a predetermined size and length in the sill of each room and inserting posts in said holes;

(c) pouring a concrete floor in said rooms on top of said posts;

(d) back-filling the rooms with a suitable fill;

(e) once a complete lift is so mined, repeating this mining procedure by undercutting on a lower level where the concrete floors now serve as a roof supported by the said posts; and (f) continuing mining in this manner from level to level in the downward direction until the ore body is mined.

16. Method according to claim 15, in which additional posts are installed at each level under the first level, between the concrete floor of said level and the concrete roof of the preceding level, to provide further support for said roof.

17. Method according to claim 16, in which said additional posts are installed on top of the posts inserted into holes drilled into the sill of each mined level under the concrete roof formed above, so that when the new concrete floor is poured, it ties the ends of all said posts.

18. Method according to claim 17, in which said additional posts are positioned adjacent to the original posts supporting the concrete roof so as to facilitate tying them all together and provide a double-post system for supporting the concrete roof at each level.

19. Method according to claim 18, in which the holes are drilled in the sill at predetermined grid-spaced intervals.

20. Method according to claim 19, in which the design with respect as to post-grid spacing and floor-post concrete tie-in is so engineered as to provide a safe and economical mining operation.

21. Method according to claim 20, in which the floor is suitably designed with rebar and screen within the concrete, so that the posts cannot puncture the same.

22. Method according to claim 21, in which at least some of the posts are reinforced concrete posts.

23. Method according to claim 22, in which the posts that are inserted into the holes drilled in the sill are reinforced concrete posts.

24. Method according to claim 23, in which small blast holes are drilled around the holes with inserted concrete posts and are blasted to break the ground around said posts without damaging the posts, prior to pouring the concrete floor.

25. Method according to claim 15, in which the undercutting is done by drill-and-blast method.

* * * * *